US006790004B2

(12) United States Patent
Steinheiser

(10) Patent No.: US 6,790,004 B2
(45) Date of Patent: Sep. 14, 2004

(54) CEILING FAN AIR CLEANER AND FRESHENER

(76) Inventor: Donald V. Steinheiser, 3361 2nd Ave., NE., Naples, FL (US) 34120

( * ) Notice: Subject to any disclaimer, the term of this patent is extended or adjusted under 35 U.S.C. 154(b) by 75 days.

(21) Appl. No.: 10/288,638

(22) Filed: Nov. 4, 2002

(65) Prior Publication Data

US 2004/0086386 A1 May 6, 2004

(51) Int. Cl.[7] ..... F04D 29/70

(52) U.S. Cl. ..... 416/65; 416/5; 416/146 R; 55/385.1; 95/78; 96/63; 422/121

(58) Field of Search ..... 416/5, 62, 146 R; 55/385.1; 95/78, 277; 96/63, 97; 422/121, 122, 123, 124

(56) References Cited

U.S. PATENT DOCUMENTS 3,742,547 A 7/1973 Sohmer
4,422,824 A 12/1983 Eisenhardt, Jr.
4,455,636 A 6/1984 Tsutsui et al.
4,753,573 A 6/1988 McKnight
4,840,650 A * 6/1989 Matherne ..... 55/385.1
4,889,543 A 12/1989 Burt
5,383,765 A * 1/1995 Baxter et al. ..... 416/62
5,422,078 A 6/1995 Colon
5,562,412 A 10/1996 Antonelli
6,183,201 B1 * 2/2001 Maby ..... 416/170 R
6,413,047 B1 7/2002 Green

* cited by examiner

*Primary Examiner*—Edward K. Look
*Assistant Examiner*—Igor Kershteyn

(57) ABSTRACT

A ceiling-fan air purifier and freshener has an edge clip (1) which is adapted to be clipped onto leading edges of fan blades (2) of ceiling fans (3) in either direction of rotation has a gluey adhesive (11) on a top surface of the edge clip. The gluey adhesive captures and contains dust and germs that are too small to be retained by air strainers and filters and that can increase instead of stop growth of germs in room air. It is intended to be used for hospitals, residences and businesses. The edge clip is adapted for: (a) reliable attachment, (b) structural compatibility with select classes of ceiling fans, (c) easy removal, (d) low-cost replacement and (d) user-friendliness. It is adaptable for being colored and designed for matching aesthetics of the select classes of ceiling fans and use conditions. The gluey adherent can include predetermined surface corrugation and unevenness for maximizing germ and particle retainment. Preferably, the gluey adhesive includes fragrances and disinfectants for odorizing and disinfecting room air.

21 Claims, 3 Drawing Sheets

CEILING FAN AIR CLEANER AND FRESHENER

BACKGROUND OF THE INVENTION

This invention relates to ceiling-fan air cleaners, air purifiers, dust removers, air fresheners and fragrance dispensers.

There are known ceiling-fan dust removers, air fresheners and fragrance dispensers for placement on fan blades, but none with a gluey adhesive surface that adheres dust particles, germs and pollen to quick-change strips that also can dispense fragrance and disinfectant for room air inexpensively, easily and thoroughly without deterring fan rotation in a manner taught by this invention.

Previous ceiling-fan devices for accomplishing these objectives have employed primarily strainers and filters that restrict fan movement, that are more expensive to produce and more difficult to attach, to replace and to maintain.

Most importantly for hospital and other health-care conditions, as well as for residential and business conditions, germs in room air can be captured and retained with the gluey adhesive, but not by filters and strainers in air conditioners, ceiling fans or other air-filtering systems. Germs are too small to be retained by strainers and filters. With strainers and filters, dust and particles with which germs and objectionable substances are transmitted can be retained and thereby decrease their transmittal media temporarily. However, passage of through contaminated air strainers and filters is as likely to spread as to deter air infestation.

Examples of most-closely related known but different devices are described in the following patent documents:

| U.S. Pat. No. | Inventor: | Issue Date: |
|---|---|---|
| 4,753,573 | McKnight | Jan. 28, 1988 |
| 5,422,078 | Colon | Jun. 06, 1995 |
| 6,413,047 | Green | Jul. 02, 2002 |
| 4,840,650 | Matherne | Jun. 20, 1989 |
| 5,562,412 | Antonelli | Oct. 08, 1996 |
| 4,889,543 | Burt | Dec. 26, 1989 |
| 3,742,547 | Sohmer | Jul. 03, 1973 |
| 4,455,636 | Tsutsui, et al. | Jun. 19, 1984 |
| 4,422,824 | Eisenhardt, Jr. | Dec. 27, 1983 |

SUMMARY OF THE INVENTION

Objects of patentable novelty and utility taught by this invention are to provide a ceiling-fan air purifier and freshener which inexpensively and conveniently can remove dust, pollen, offensive odors and germs from room air without increasing growth of germs in a strainer or filter while also optionally dispensing fragrance. This invention also makes it easier to clean fan blades as dust collects on the invention rather than the entire fan blades.

This invention accomplishes these and other objects with a ceiling-fan air purifier and freshener having an edge clip that is adapted to clip onto leading edges of ceiling fans in either direction of rotation and has a gluey adhesive on a top surface of the edge clip. The edge clip is adapted for reliable attachment, structural compatibility with select classes of ceiling fans, easy removal and low-cost replacement. It is adapted also for being colored and designed for matching aesthetics of the select classes of ceiling fans. Optionally, the gluey adherent can include predetermined surface corrugation and unevenness for maximizing adhesive retainment capacity. Optionally also, fragrances and disinfectants can be included in the gluey adhesive.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
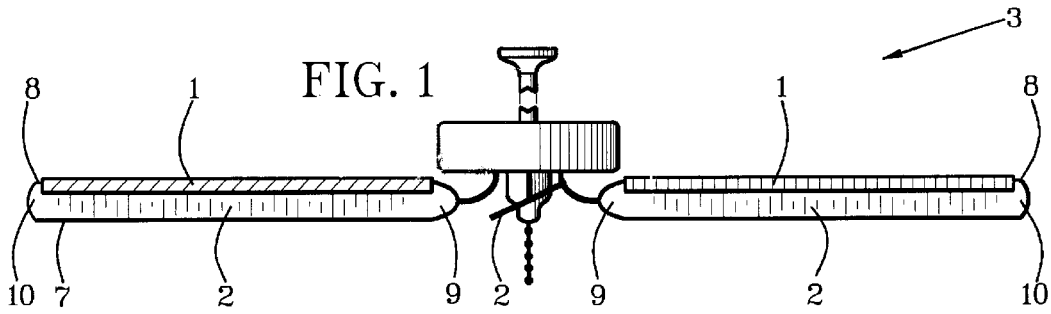
FIG. 1 is a partially cutaway side view of edge clips with gluey adhesive on top surfaces of leading edges of fan blades on a ceiling fan rotating in direction to direct airflow downwardly.

Listed numerically below with reference to the drawings are terms used to describe features of this invention. These terms and numbers assigned to them designate the same features throughout this description.

1. Edge clip
2. Fan blade
3. Ceiling fan
4. Top wall
5. Bottom wall
6. Front wall
7. Bottom edge
8. Top edge
9. Hub portion

Figure 2:
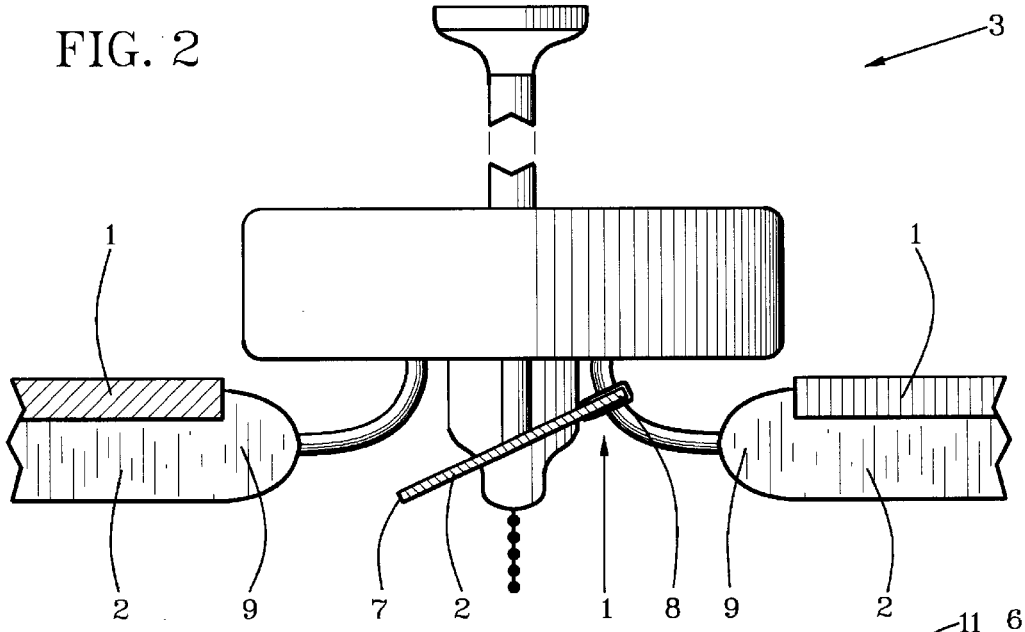
FIG. 2 is an enlarged fragmentary view of a central portion of the FIG. 1 illustration.
Figure 3:
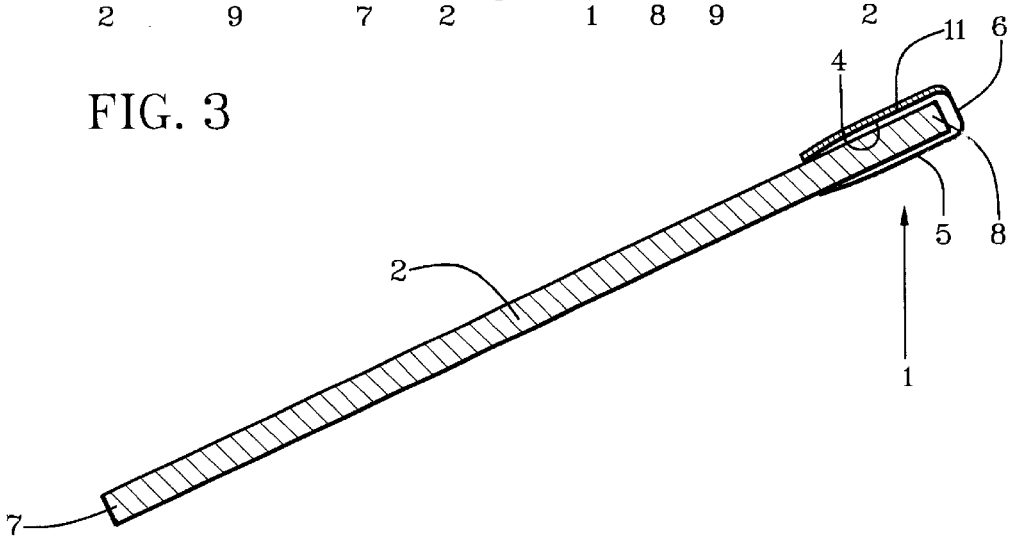
FIG. 3 is a further enlarged fragmentary view of an end of a fan blade shown in the FIG. 2 illustration with walls of the edge clip being forced against the leading edge of a fan blade.
Figure 4:
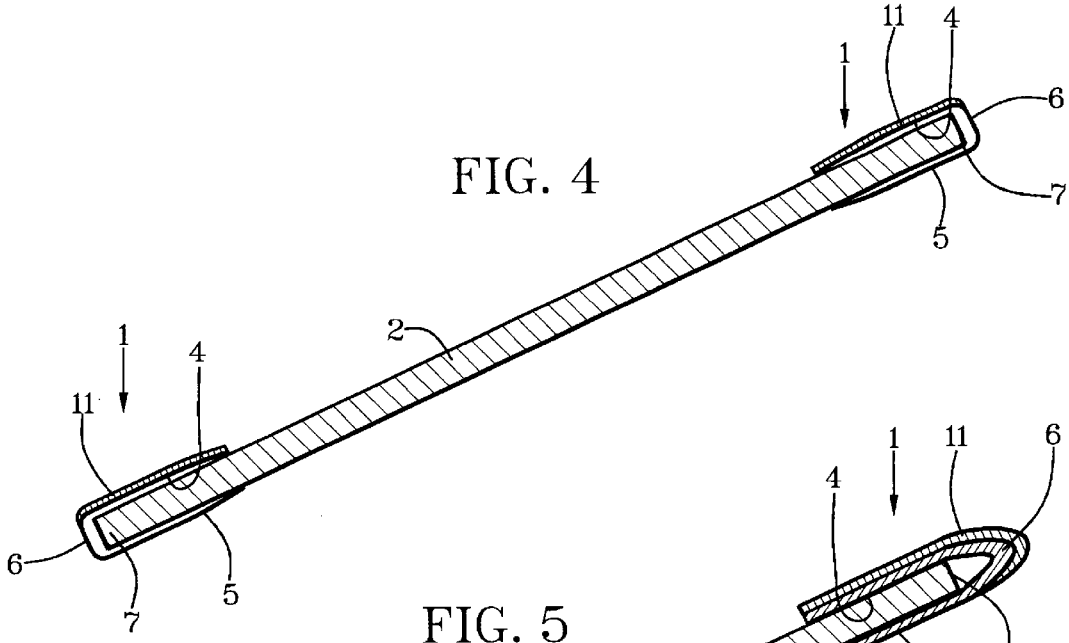
FIG. 4 is the FIG. 3 illustration with a first edge clip on a first leading edge and a second edge clip on a second leading edge of a fan blade for optionally reverse rotation of the ceiling fan.
Figure 5:
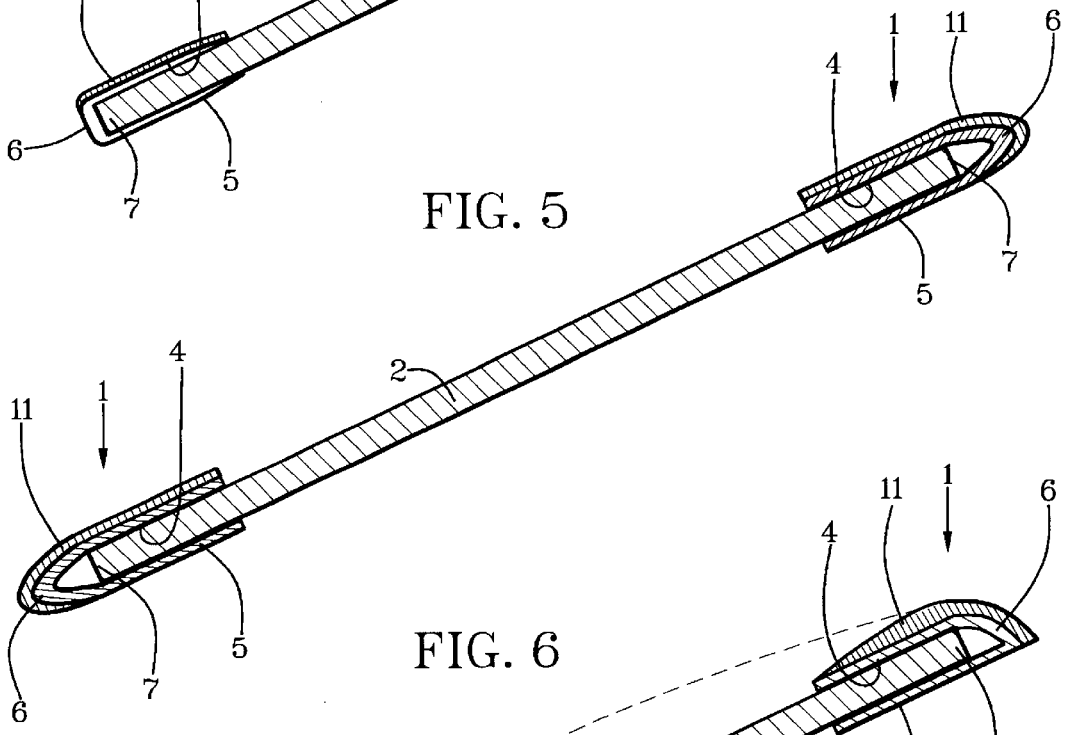
FIG. 5 is the FIG. 4 illustration with the edge clips being arcuately pointed for minimizing air turbulence.

10. Terminal portion
11. Gluey adhesive
12. Snap-on protrusion
13. Snap-on recess Referring to FIGS. 1–3, the ceiling-fan air purifier and freshener includes an edge clip 1 adapted to be clipped onto a leading edge of a fan blade 2 of a predetermined class of fan blades for ceiling fans 3. The edge clip 1 has a top wall 4 and a bottom wall 5 that are joined by a front wall 6. The leading edge can be either a bottom edge 7 or a top edge 8, depending on circumferential direction in which the fan blade 2 is being rotated by the ceiling fan 3. Similarly, a trailing edge can be either a bottom edge 7 or the top edge 8, depending on circumferential direction in which the fan blade 2 is being rotated by the ceiling fan 3.

The top wall 4 and the bottom wall 5 of the edge clip have clip-wall widths for covering a predetermined portion of a fan-blade width intermediate a leading edge and a trailing edge, which can be the bottom edge 7 and the top edge 8 of the fan blade 2. The edge clip 1 has a clip-wall length for covering a predetermined portion of a length of the fan blade 2 intermediate a hub portion 9 and a terminal portion 10 of the fan blade 2.

The top wall 4 of the edge clip 1 has a top-wall surface that is coated with a predetermined gluey adhesive 11 for adherence containment of impurities of room air contacted by the gluey adhesive 11 from rotation of the fan blade 2 with the ceiling fan 3. The edge clip 1 is adapted for removable and replaceable attachment to the fan blade 2 predeterminedly for removing the impurities of the room air that are adhered to the gluey adhesive 11.

The top wall 4 and the bottom wall 5 of the edge clip 1 are spring-forced together towards each other with resilient spring force in the top wall 4, the front wall 6 and the bottom wall 5 for spring-force squeezing the top wall 4 and the bottom wall 5 against a top surface and a bottom surface of the fan blade 2 that is placed between the top wall 4 and the bottom wall 5 for removable and replaceable attachment of the edge clip 1 to the leading edge of the fan blade 2.

Referring to FIGS. 4–10, the leading edge of the fan blade can include a first leading edge which is the top edge 8 that is on a side of the fan blade 2 which slants downwardly aft of the leading edge for downward direction of fanned air by rotation of a ceiling fan 3 in a circumferential direction of the first leading edge. The leading edge of the fan blade 2 can include a second leading edge which is the bottom edge 7 that is on a side of the fan blade 2 which slants upwardly aft of the leading edge for upward direction of fanned air by rotation of a ceiling fan 3 in a circumferential direction of the second leading edge. For this embodiment, the ceiling fan 3 on which the fan blade 2 is positioned is reversible for rotation of the fan blade 2 in the circumferential direction of the first leading edge or of the second leading edge selectively.

A first edge clip 1 can be attached to the leading edge of the fan blade 2 which slants downwardly aft of the leading edge. Optionally, a second edge clip 1 can be attached to the leading edge of the fan blade 2 which slants upwardly aft of the leading edge. Also optionally, the first edge clip 1 can be attached to the leading edge of the fan blade 2 which slants downwardly in addition to attachment of a second edge clip 1 to the leading edge of the fan blade 2 which slants upwardly aft of the leading edge.

As shown in FIGS. 5, 7–8 and 10, the front wall 6 of the edge clip 1 can be contoured arcuately with predetermined sharpness which avoids airfoil eddies for directing airflow over the top wall 4 of the edge clip 1 for engagement of the air and impurities therein with the gluey adhesive 11.

Figure 6:
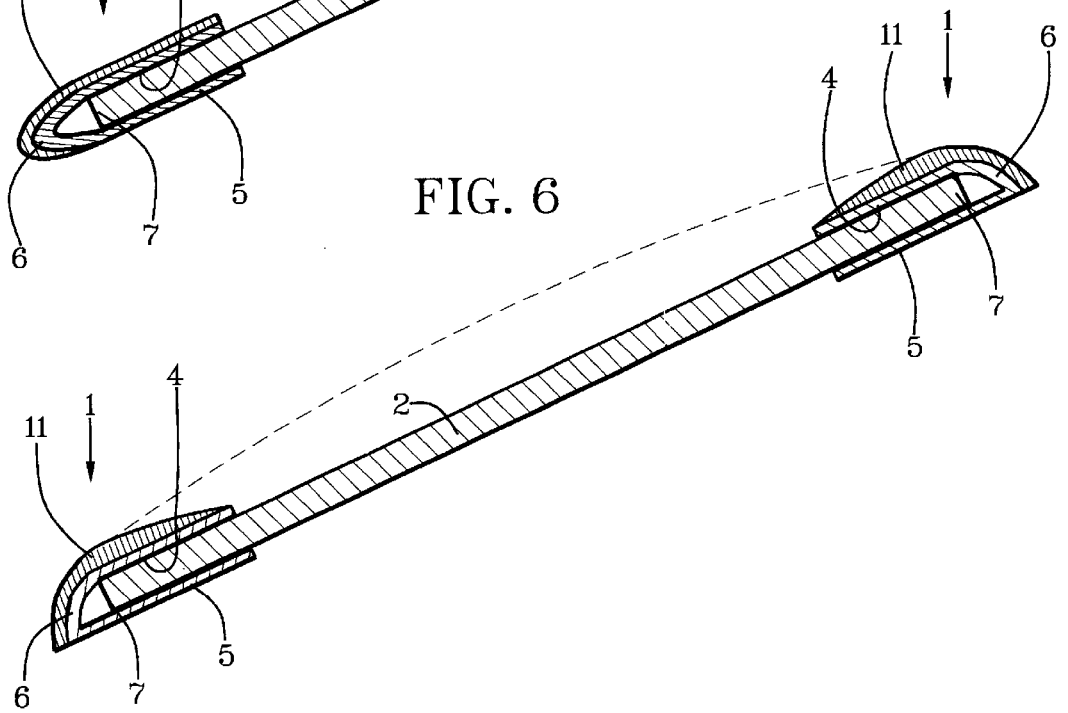
FIG. 6 is the FIG. 5 illustration with the edge clips being arcuately contoured to direct airflow upwardly from an edge clip on a first leading edge and downwardly to an edge clip on a second leading edge.
Figure 7:
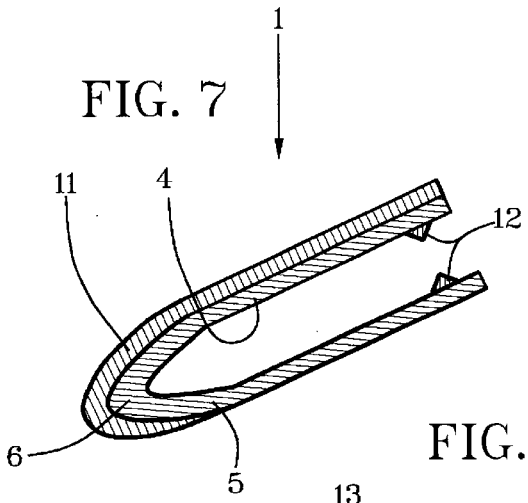
FIG. 7 is an end view of an edge clip for a leading edge of the fan blade rotating in a circumferential direction for directing airflow upwardly and having protrusions for engaging recesses in the fan blade.
Figure 8:
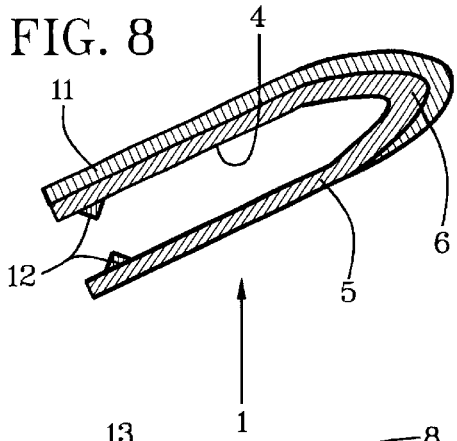
FIG. 8 is an end view of an edge clip for a leading edge of the fan blade rotating in a circumferential direction for directing airflow downwardly and having protrusions for engaging recesses in the fan blade.
Figure 9:
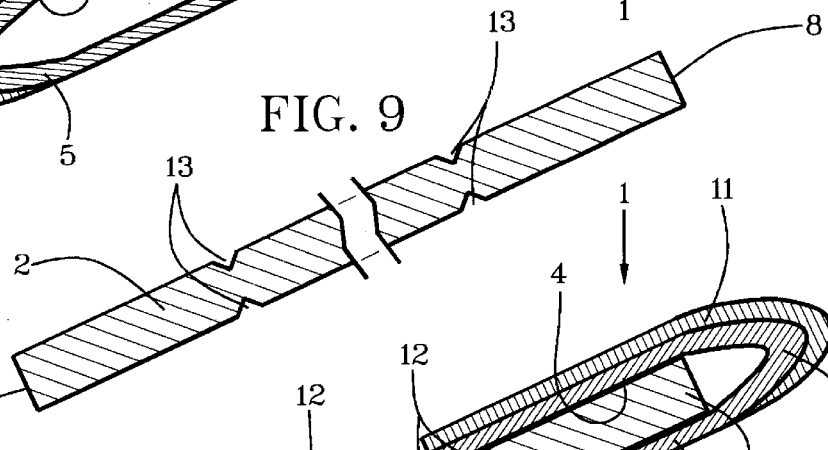
FIG. 9 is a partially cutaway fragmentary end view of opposite sides of a fan blade having recesses for receiving the protrusions on the edge clips.
Figure 10:
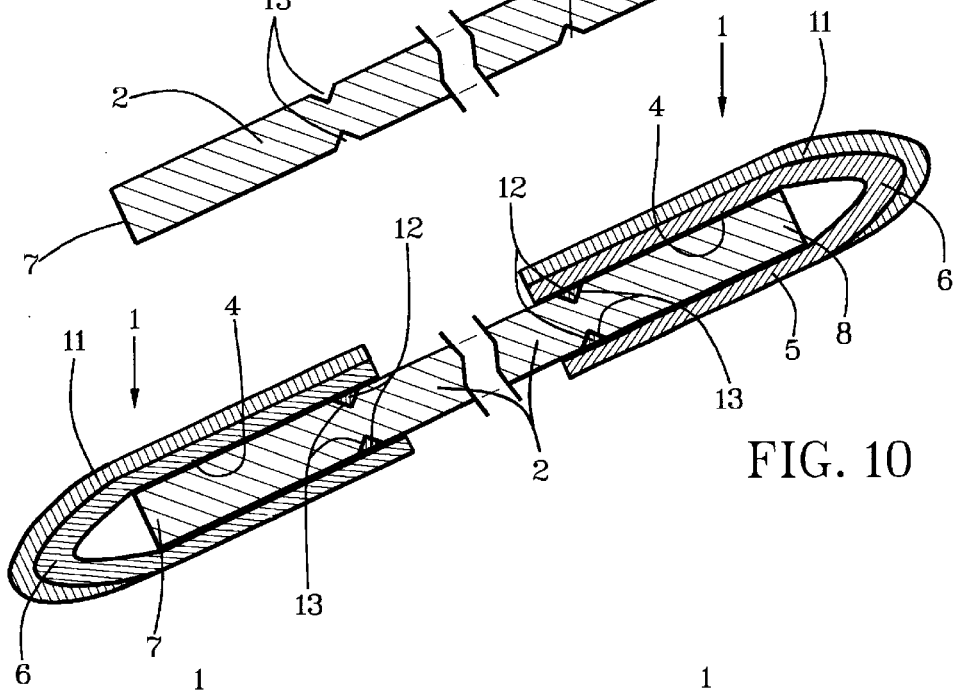
FIG. 10 is a cutaway fragmentary end view of the FIGS. 7–8 edge clips on the FIG. 9, fan blade with the protrusions on the edge clips inserted into the recesses in the fan blade.

As shown in FIG. 6, the front wall 6 of the edge clip 1 can be contoured arcuately for directing airflow over the top wall 4 of the edge clip 1 for engagement of the air and impurities therein with the gluey adhesive 11 and then for directing the airflow upwardly to deter further airflow contact of the air with remaining aft portions of the fan blade 2.

As shown further in FIG. 6, with the first edge clip 1 attached to a first leading edge of the fan blade 2 for a first rotational direction of the ceiling fan 3 and with the second edge clip 1 attached to a second leading edge of the fan blade 2 for a second rotational direction of the ceiling fan 3, the front wall 6 of the first edge clip 1 can be contoured arcuately for directing airflow over the top wall 4 of the first edge clip 1 for engagement of the air and impurities therein with the gluey adhesive 11 of the first edge clip 1, then for directing the airflow upward arcuately to deter further airflow contact of the air with remaining aft portions of the fan blade 2 that are forward from the second edge clip 1 and then finally for allowing arcuately downward direction of the airflow for airflow contact of the air and any remaining impurities therein with the gluey adhesive 11 on the top wall 4 of the second edge clip 1. The airflow between the first edge clip 1 and the second edge clip 1, therefore, follows an arcuate path indicated approximately by a dashed line between the gluey adhesive 11 of the first leading edge and the second leading edge in either circumferential direction of rotation.

As shown in FIGS. 7–10, the edge clip 1 with either form of the front wall 6 for either leading edge can include at least one snap-on protrusion 12 for engaging at least one snap-on recess 13 in the fan blade 2.

The edge clip 1 is made preferably of resilient plastic material and can include inside surfaces that are rough rubberlike for nonskid attachment to the fan blade 2.

Figure 11:
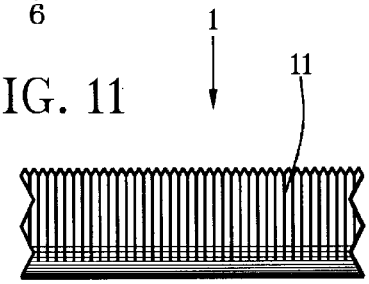
FIG. 11 is a partially cutaway fragmentary front view of an edge clip having corrugated gluey adhesive on a top surface.
Figure 12:
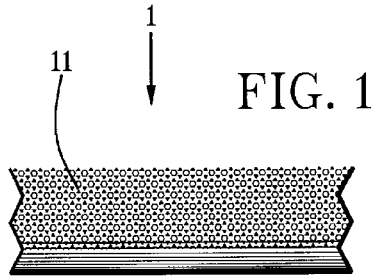
FIG. 12 is a partially cutaway fragmentary front view of an edge clip having uneven or nonskid gluey adhesive on the top surface.

The gluey adhesive 11 can be corrugation-surfaced as shown in FIG. 11 or unevenly surfaced as shown in FIG. 12 for enlargement of airflow-contact area and for enhanced entrapment of germs and dust.

The gluey adhesive 11 can include predetermined fragrance for room odorizing and/or can include predetermined disinfectant for disinfecting room air. Additionally, the gluey adhesive 11 can include predetermined coloring. The bottom surface of the edge clip 1 also can include predetermined coloring.

A selection of shapes, sizes and adaptations of structures of the edge clips 1 for shapes, sizes and structures of fan blades 2 are foreseeable within the scope of this invention. Variations of chemical content and consistency of the gluey adhesive 11 also are foreseeable.

A new and useful ceiling-fan air purifier and freshener having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A ceiling-fan air purifier and freshener comprising:

an edge clip adapted to be clipped onto a leading edge of a fan blade of a predetermined class of fan blades for ceiling fans;

the edge clip having a top wall and a bottom wall that are joined by a front wall;

the top wall and the bottom wall of the edge clip having clip-wall widths for covering a predetermined portion of a fan-blade width intermediate a leading edge and a trailing edge of the fan blade;

the edge clip having a clip-wall length for covering a predetermined portion of a length of the fan blade intermediate a hub portion and a terminal portion of the fan blade;

the top wall of the edge clip having a top-wall surface that is coated with a predetermined gluey adhesive for adherence containment of impurities of room air contacted by the gluey adhesive from rotation of the fan blade with a ceiling fan; and the edge clip being adapted for removable and replaceable attachment to the fan blade predeterminedly for removing the impurities of the room air that are adhered to the gluey adhesive.

2. The ceiling-fan air purifier and freshener of claim 1 wherein:

the top wall and the bottom wall of the edge clip are spring-forced together towards each other with resilient spring force in the top wall, the front wall and the bottom wall for spring-force squeezing the top wall and the bottom wall against a top surface and a bottom surface of the fan blade that is placed between the top wall and the bottom wall for removable and replaceable attachment of the edge clip to the leading edge of the fan blade.

3. The ceiling-fan air purifier and freshener of claim 1 wherein:

the leading edge of the fan blade includes a first leading edge on a side of the fan blade which slants downwardly aft of the leading edge for downward direction of fanned air by rotation of a ceiling fan in a circumferential direction of the first leading edge;

the leading edge of the fan blade includes a second leading edge on a side of the fan blade which slants upwardly aft of the leading edge for upward direction of fanned air by rotation of the ceiling fan in a circumferential direction of the second leading edge; and a ceiling fan on which the fan blade is positioned is reversible for rotation of the fan blade in the circumferential direction of the first leading edge or of the second leading edge selectively.

4. The ceiling-fan air purifier and freshener of claim 3 wherein:

a first edge clip is attached to the leading edge of the fan blade which slants downwardly aft of the leading edge.

5. The ceiling-fan air purifier and freshener of claim 3 wherein:

a second edge clip is attached to the leading edge of the fan blade which slants upwardly aft of the leading edge.

6. The ceiling-fan air purifier and freshener of claim 5 wherein:

the first edge clip is attached to the leading edge of the fan blade which slants downwardly aft of the leading edge.

7. The ceiling-fan air purifier and freshener of claim 1 wherein:

the front wall of the edge clip is contoured arcuately with predetermined sharpness to avoid airfoil eddies for directing airflow over the top wall of the edge clip for engagement of the air and impurities therein with the gluey adhesive.

8. The ceiling-fan air purifier and freshener of claim 1 wherein:

the front wall of the edge clip is contoured arcuately for directing airflow over the top wall of the edge clip for engagement of the air and impurities therein with the gluey adhesive and then for directing the airflow upwardly to deter further airflow contact of the air with remaining aft portions of the fan blade.

9. The ceiling-fan air purifier and freshener of claim 8 wherein:

the first edge clip is attached to a first leading edge of the fan blade for a first rotational direction of the ceiling fan;

the second edge clip is attached to a second leading edge of the fan blade for a second rotational direction of the ceiling fan;

the front wall of the first edge clip is contoured arcuately for directing airflow over the top wall of the first edge clip for engagement of the air and impurities therein with the gluey adhesive of the first edge clip, then for directing the airflow upward arcuately to deter further airflow contact of the air with remaining aft portions of the fan blade that are forward from the second edge clip and then finally for allowing arcuately downward direction of the airflow for airflow contact of the air and any remaining impurities therein with the gluey adhesive on the top wall of the second edge clip.

10. The ceiling-fan air purifier and freshener of claim 1 wherein:

the edge clip includes at least one snap-on protrusion for engaging at least one snap-on recess in the fan blade.

11. The ceiling-fan air purifier and freshener of claim 10 and further comprising:

a fan blade having at least one snap-on recess for engaging the at least one snap-on protrusion on the edge clip.

12. The ceiling-fan air purifier and freshener of claim 1 wherein:

the edge clip is made of resilient plastic material.

13. The ceiling-fan air purifier and freshener of claim 1 wherein:

the edge clip includes inside surfaces that are rough rubberlike for nonskid attachment to the fan blade.

14. The ceiling-fan air purifier and freshener of claim 1 wherein:

the gluey adhesive is corrugation-surfaced for enlargement of airflow-contact area.

15. The ceiling-fan air purifier and freshener of claim 1 wherein:

the gluey adhesive is unevenly surfaced for enlargement of airflow-contact area.

16. The ceiling-fan air purifier and freshener of claim 1 wherein:

the gluey adhesive includes predetermined fragrance.

17. The ceiling-fan air purifier and freshener of claim 1 wherein:

the gluey adhesive includes predetermined disinfectant.

18. The ceiling-fan air purifier and freshener of claim 17 wherein:

the gluey adhesive includes predetermined fragrance.

19. The ceiling-fan air purifier and freshener of claim 1 wherein:

the gluey adhesive includes predetermined coloring.

20. The ceiling-fan air purifier and freshener of claim 19 wherein:

the bottom surface of the edge clip includes predetermined coloring.

21. The ceiling-fan air purifier and freshener of claim 1 wherein:

the bottom surface of the edge clip includes predetermined coloring.

* * * * *